US005775149A

United States Patent [19]

Small

[11] Patent Number: 5,775,149

[45] Date of Patent: Jul. 7, 1998

[54] DEVICE FOR PREVENTING DOOR LOCK ACCESS

[76] Inventor: Keith R. Small, 1848 Forest Lake Dr., Rock Hill, S.C. 29732

[21] Appl. No.: 785,864

[22] Filed: Jan. 21, 1997

[51] Int. Cl.[6] ..... E05B 13/00

[52] U.S. Cl. ..... 70/416; 70/63; 109/50; 292/289

[58] Field of Search ..... 70/54–56, 63, 70/416, 417, 452, 454, 455, 462; 292/288, 289, 337, 346, DIG. 9, 17; 109/49.5, 50–52

[56] References Cited

U.S. PATENT DOCUMENTS

| | | | |
|---|---|---|---|
| 3,559,429 | 2/1971 | Hermann | 70/85 |
| 3,934,434 | 1/1976 | Law | 70/63 |
| 4,112,717 | 9/1978 | Bradley | 70/63 |
| 4,139,999 | 2/1979 | Allenbaugh | 70/452 |
| 4,694,668 | 9/1987 | Ciletti et al. | 109/50 X |
| 4,706,775 | 11/1987 | Berg | 70/237 X |
| 4,770,451 | 9/1988 | Souza | 292/289 |
| 4,799,370 | 1/1989 | Cooper | 70/63 |
| 4,909,052 | 3/1990 | Hutwohl | 70/63 |
| 5,080,354 | 1/1992 | McDougall | 292/145 |
| 5,084,945 | 2/1992 | Childers | 70/63 X |
| 5,291,760 | 3/1994 | Schrader | 70/14 |
| 5,590,608 | 1/1997 | Yore et al. | 109/50 |

*Primary Examiner*—Suzanne Dino-Barrett

[57] ABSTRACT

A device for blocking access to a lock associated with a door when the door is closed includes a body having an arrangement for covering an operating interface of a lock associated with the door, an arrangement formed as a part of the body for selectively attaching the device to the door, with the attaching arrangement including a face portion for extending across a portion of the face surface of the door, a strike portion for extending across a portion of the strike surface of the door, and an arrangement formed in the body for preventing removal of the covering assembly from the door when the device is mounted to a door.

5 Claims, 9 Drawing Sheets

DEVICE FOR PREVENTING DOOR LOCK ACCESS

BACKGROUND OF THE INVENTION

The present invention relates broadly to doorway security devices and, more particularly, to a device for denying access to operational components of locks, such as keyholes or combination dials, associated with doors, primarily residential doors.

Several situations may arise wherein a homeowner would want to deny entry to someone who has access to a key to the home. The common situation where this may arise is in a case of a realtor lockbox. Real estate agents will generally use a lockbox to store house keys at a home that is for sale. The lockbox consists of a staple for fitment around a shank associated with a door knob in the manner of padlock. A compartment is associated with the lockbox which is accessible using a combination or dedicated key. The house keys are stored inside the lockbox and when a house is to be inspected for possible sale, a realtor will open the lockbox to gain access to the house keys to thereby gain access to the home. This system provides convenience for any number of real estate agents who may happen by to show the house to prospective buyers. Therefore, the lockbox is suspended from the door knob during the time the house is on the market.

There are times when a homeowner may wish to deny access to those who would retrieve keys from the lockbox. It should be remembered that the homeowner has no access to the contents of the lockbox and cannot merely remove the keys therefrom. For example, should the homeowner be entertaining or, for example, in the shower or bath, or even ill in bed, it may become desirable to temporarily deny access to the lockbox to prevent unwanted entry during such private moments.

Another situation which may arise surrounds a deadbolt lock which has a keyhole facing the exterior portion of the door. As may be expected, if someone has a key to the deadbolt lock, that person may enter the house or dwelling at will. Situations sometimes arise where the owner or occupant wishes to deny access to the interior even to those with keys. The situation could be where the occupants of an apartment may want to deny access to resident managers or maintenance personnel such as in the above-discussed private moments. Additionally, guests in motels or hotels and boarding houses may wish to deny access to maintenance personnel as well as former occupants of the room. Other, more sinister problems may arise. For example, people who have obtained a restraining order against a former member of the household still in possession of the key may wish to deny them entry. Further, a locksmith may not be readily available to rekey doors in a house should that be necessary. In addition to the above, it may be desirable to deny access to a photography darkroom when in use.

In all the above-discussed instances, someone with access to a key may enter a house against the will of the owner with the owner inside. Therefore, there exists a need for a device which will deny access to realtors' lockboxes and deadbolts, i.e., key access with regard to a home or other dwelling.

SUMMARY OF THE INVENTION

It is accordingly an object of the present invention to provide a mechanical device which will deny access to an operational interface of a lock associated with a door.

It is another object of the present invention to provide such a device that is easily installed and removed from a door and cannot be circumvented without door removal.

To that end, a device for blocking access to a lock associated with a door when the door is closed, with the device being attachable and detachable from a door having an inside face and outside face and a strike face, includes a body having an arrangement for covering an operating interface of a lock associated with a door and assembly formed as a portion of the body for selectively attaching the device to a door, with the attaching assembly including a face portion for extending across a portion of a face surface of the door and a strike portion for extending across a portion of the strike surface of the door and an arrangement formed in the body for preventing removal of the covering arrangement from the door when the device is mounted to the door using the mounting assembly.

It is preferred that the strike portion include an opening formed therein at a position in the strike portion for passage therethrough of a latching member associated with a door on which the device is mounted. It is further preferred that the device include a locking portion extending from the strike portion at a predetermined angular relationship therewith to extend across a second face of the door when the device is mounted to a door.

It is further preferred that the strike portion include at least two openings through which a latching member associated with a door may pass with the at least two openings being symmetrically disposed for using the device on either side of a door. It is additionally preferred that the locking portion be formed as a generally V-shaped flange for biasing a vertex of the V-shaped flange against an inside face of the door to assist in holding the device on a door.

The covering assembly preferably includes a receptacle extending from the strike portion in a disposition to extend over a first door face in size to receive therein a locking key storage container having an operating interface portion thereon.

It is alternately preferred that the covering assembly include a shield member extending from the strike portion at a disposition to be in covering relation with a keyhole formed in a deadbolt mechanism mounted to an outside face of the door when the device is mounted to a door. It is further preferred that the device further include a reinforcement plate mountable to a door intermediate the outside face thereof and a housing having the keyhole formed therein, the reinforcement plate including an assembly for mating the reinforcement plate to the shield when the device is mounted to a door. Preferably, the reinforcement plate is formed as a generally U-shaped member having at least one flange formed in the reinforcement plate extending along at least one side edge of the plate for capturing a portion of the shield when the device is mounted to a door.

As may be readily ascertained from the above, the present invention appears in two distinct preferred embodiments, one of which is intended to deny access to a realty-type lockable key storage box and the other variant is designed to deny access to a keyhole formed in the cowling of a deadbolt-type lock.

The first variant is formed as a device for blocking access to a lock associated with a door when the door is closed with the device being attachable to and detachable from a door having an inside face, and outside face, and a strike face extending therebetween, the device including a body having an assembly for attaching the body to a door with the attaching assembly including a face portion for extending across a portion of a face surface of the door and a strike portion for extending across a portion of a strike surface of the door. Further, a receptacle is attached to the body and extends from the strike portion and is sized to receive therein a locking key storage container having an operating interface portion thereon, and an arrangement formed in the body for preventing removal of the receptacle from the door when the device is mounted to the door using the mounting assembly. A retaining assembly is provided and extends from the strike portion in opposition to the receptacle and at a predetermined angular relationship with the strike portion to extend across a second face surface of the door when the device is mounted to the door.

The other variant is directed to a device for blocking access to a lock associated with a door when the door is closed with the device being attachable to and detachable from a door having an inside face, an outside face, and a strike face extending therebetween, the device including a body having an assembly for covering an operating interface of a lock associated with a door with the covering assembly including a shield member extending from the strike portion at a disposition to be in covering relation with a keyhole formed in a deadbolt mechanism mounted to an outside face of the door when the device is mounted to the door. An arrangement is formed as a portion of the body for selectively attaching the device to a door with the attaching assembly including a face portion for extending across a portion of a face surface of the door and a strike portion for extending across a portion of a strike surface of the door.

An assembly is formed in the body for preventing removal of the covering assembly from the door when the device is mounted to the door using the attaching assembly and a reinforcement plate is provided as being mountable to a door intermediate the outside face and a housing having the keyhole formed therein with the reinforcement plate including an assembly for mating the reinforcement plate to the shield when the device is mounted to the door with the reinforcement plate being formed as a generally U-shaped member having at least one flange formed in the reinforcement plate extending along at least one side edge of the plate for capturing a portion of the shield when the device is mounted to a door.

By the above, the present invention provides an inexpensive and simple device which provides enhanced security for homeowners in their respective dwellings.

DESCRIPTION OF THE PREFERRED EMBODIMENT

Figure 1:
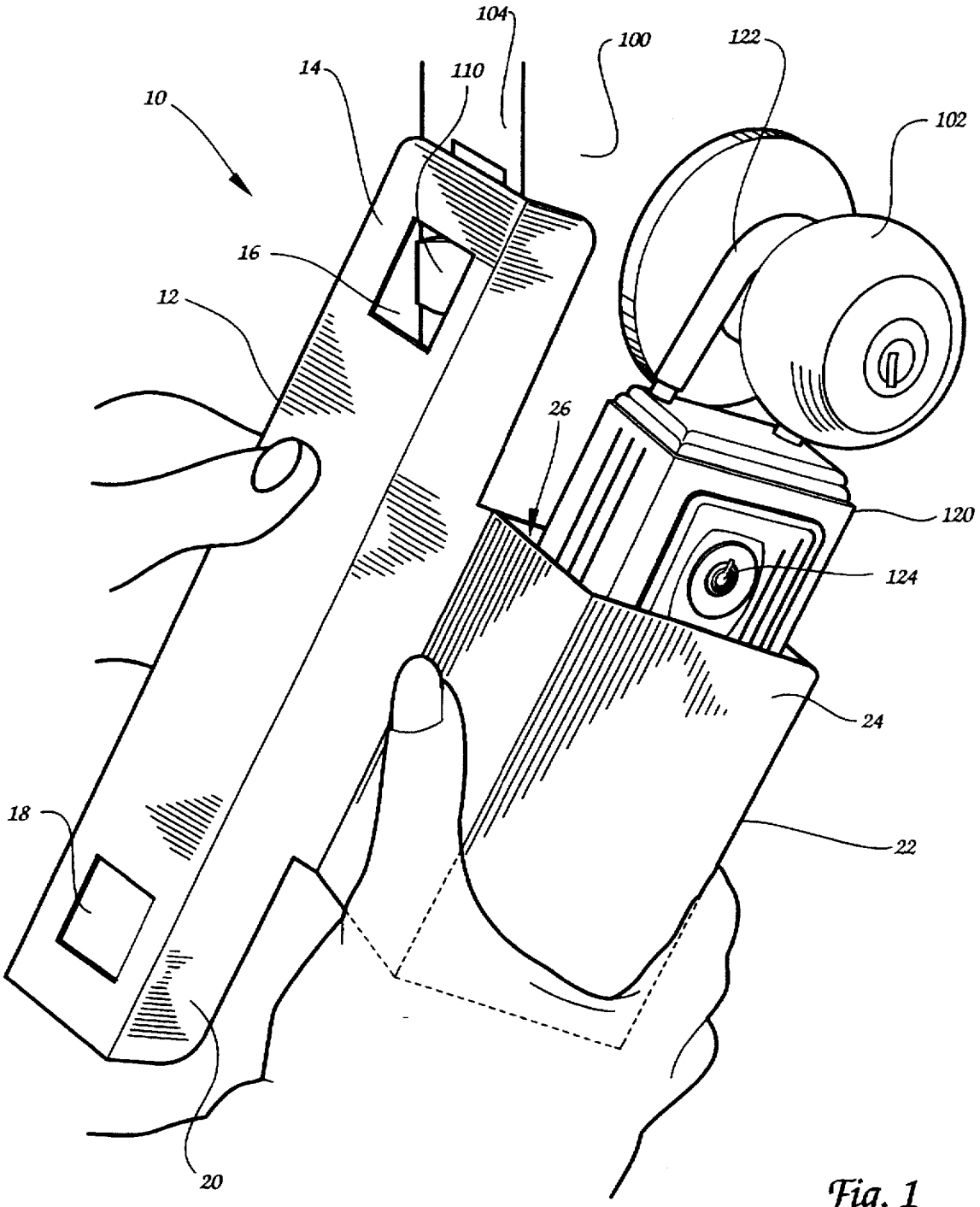
FIG. 1 is a perspective view of a device for blocking access to a lock associated with a door according to one preferred embodiment of the present invention, with the device shown during installation.

Turning now to the drawings and, more particularly to FIG. 1, one preferred embodiment of the present invention is shown in FIG. 1 during installation thereof. There, the device is illustrated generally at 10. This embodiment is best seen in FIGS. 1, 4, and 5.

As previously stated, the present invention appears in two separate embodiments. The first embodiment is preliminarily addressed above and provides the homeowner the ability to deny access to a lockable key storage container which is suspended from the shank of a door knob. A second version of the device, as will be seen in greater detail presently, provides the user with the ability to deny access to a deadbolt lock.

Returning now to FIGS. 1, 4, and 5, the first preferred embodiment of the present invention is illustrated generally at 10 and includes a body 12 having a strike portion 14 formed as a generally rectangular, planar member. The strike portion 14, as well as the remainder of the device, may be formed from any suitable material which will withstand tampering, such as stainless steel, brass, or other metal. A plurality of openings 16, 18 are formed in either end of the strike portion 14. The openings are generally square but may assume any desired shape as long as a latching member 110 associated with a door 100 may pass therethrough. A first opening 16 is disposed adjacent one end of the strike portion and a second opening 18 is disposed adjacent another end of the strike portion 14 with the openings being symmetrically spaced. As will be seen, this allows the device to be used on either lefthand or righthand opening doors.

Figure 4:
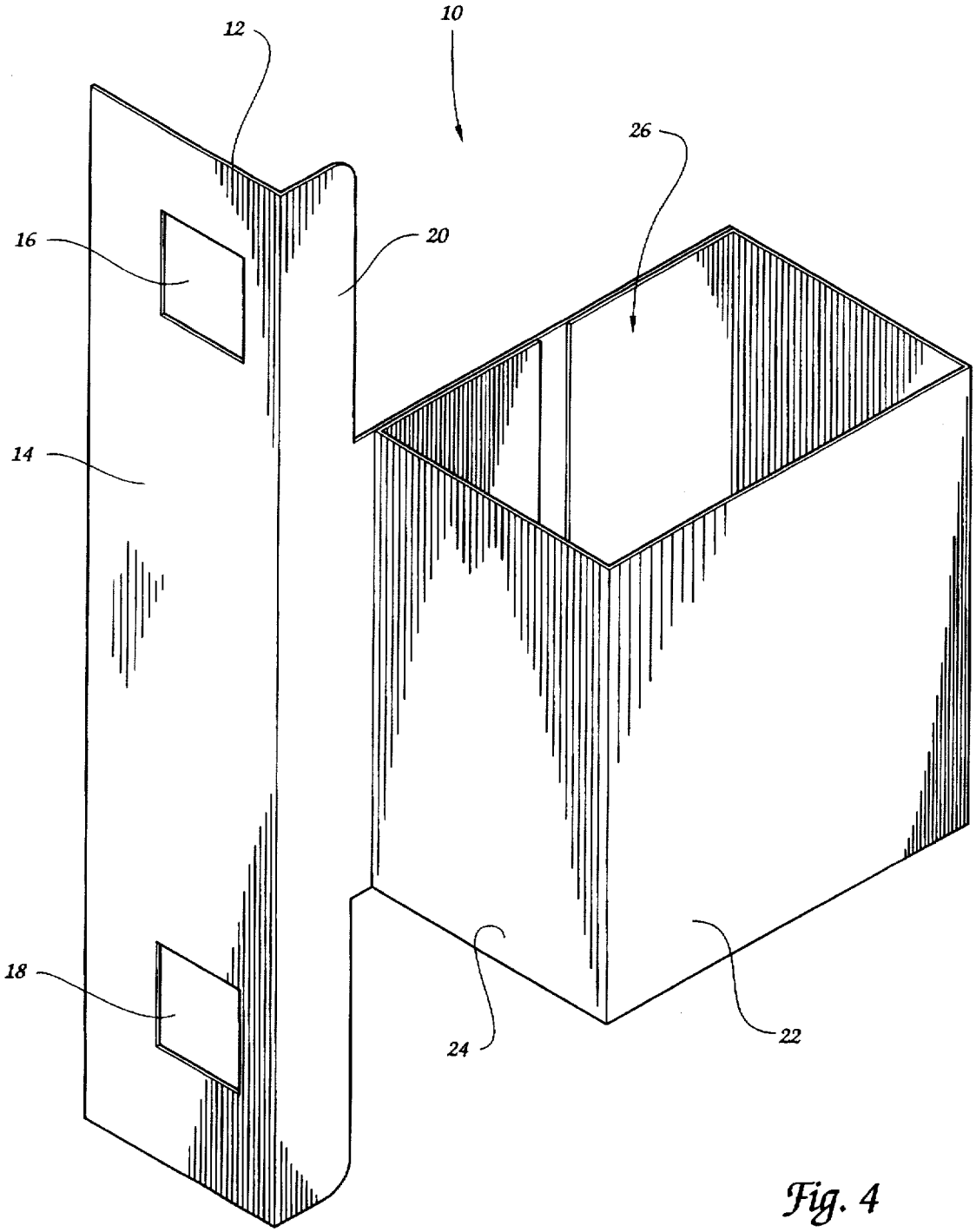
FIG. 4 is a left side, frontal perspective view of the device for blocking access to a lock illustrated in FIG. 1.
Figure 5:
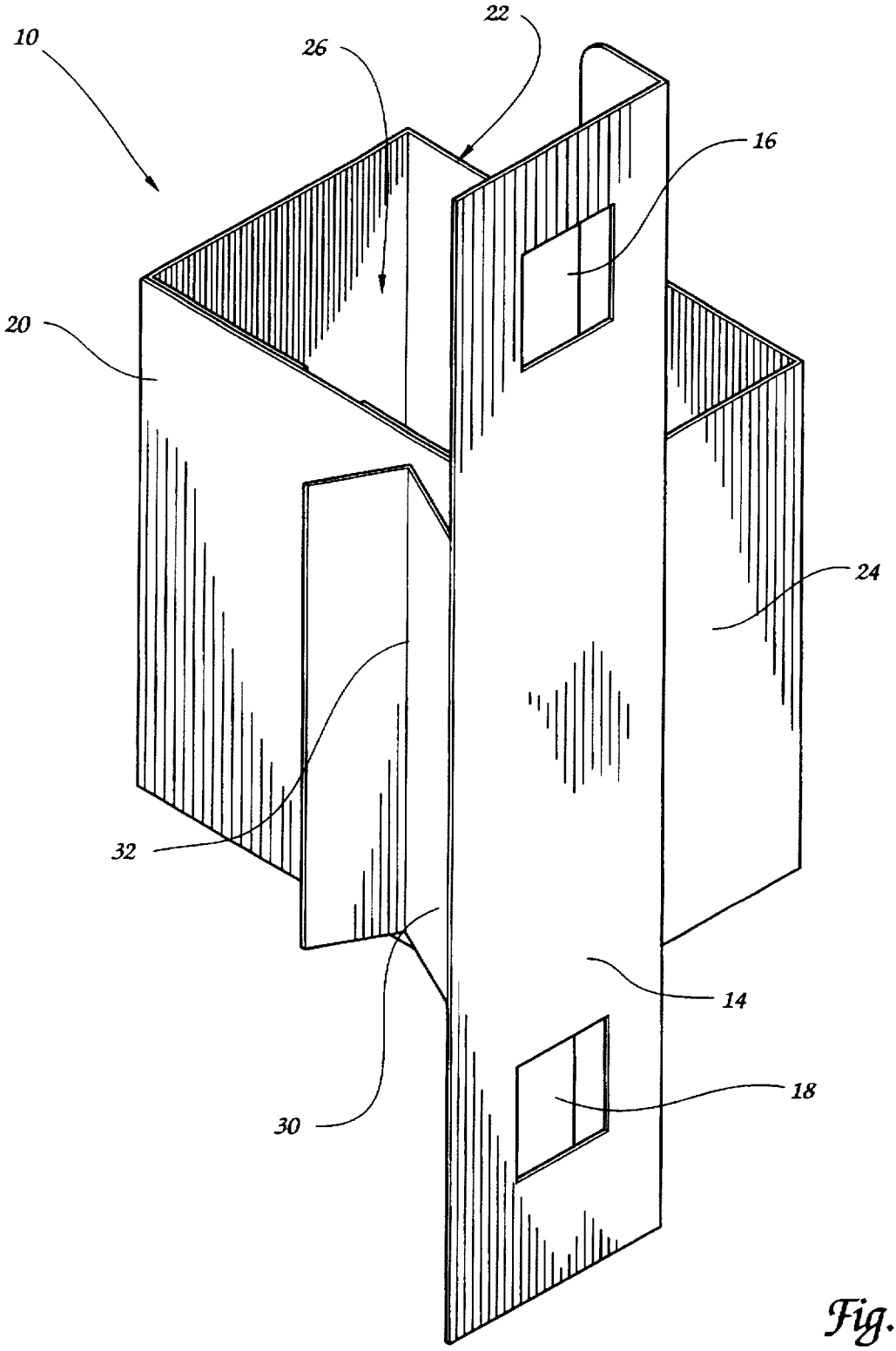
FIG. 5 is a left side, rear perspective view of the device for blocking access to a lock illustrated in FIG. 1.

Referring now to FIG. 4, a face portion 20 is formed as another planar member extending away from the strike portion 14 in a generally perpendicular relation therewith. The face portion 20 is configured for extending across a portion of an outside face of the door 100.

Figure 3:
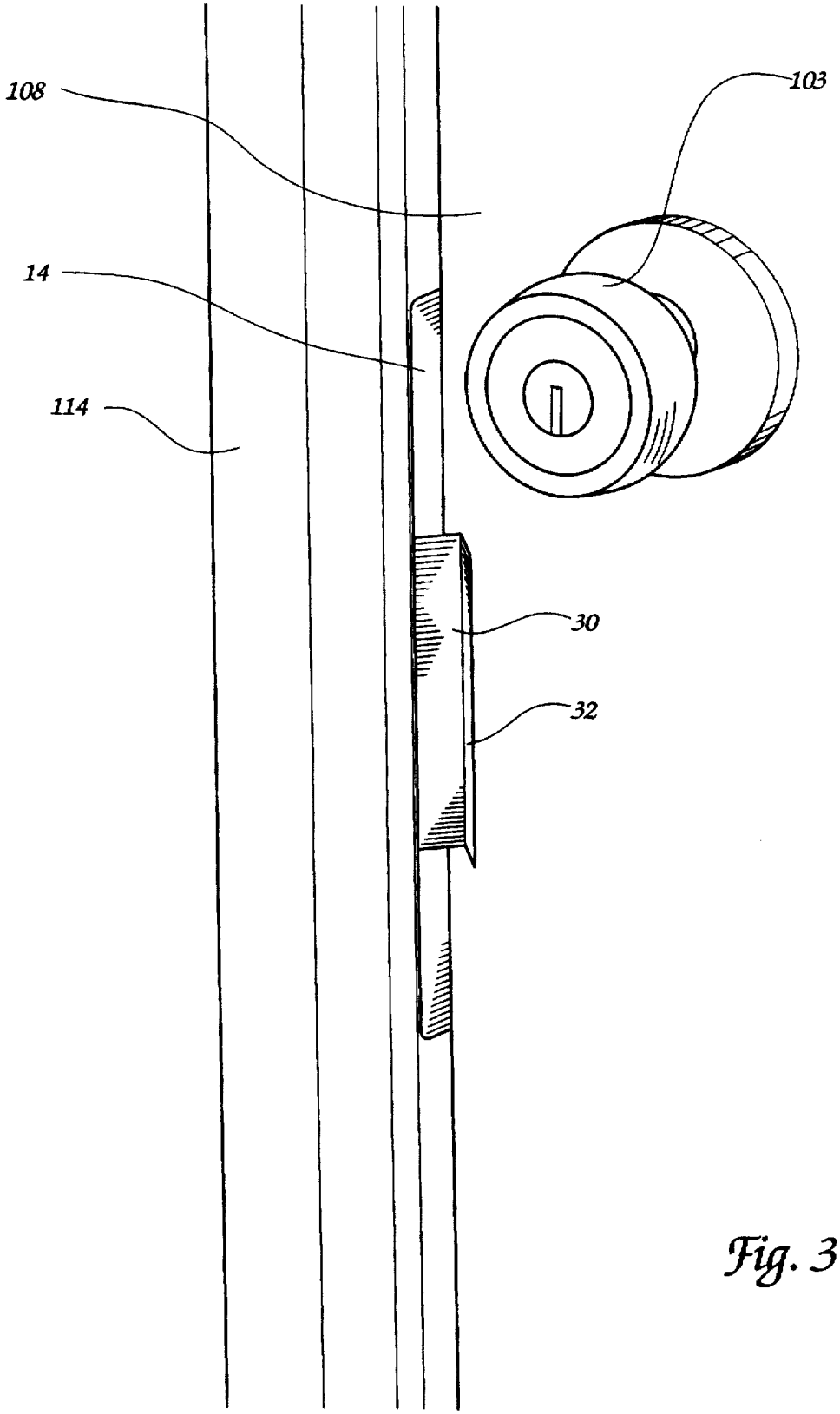
FIG. 3 is a perspective view of the device for blocking access to a lock illustrated in FIG. 1, shown from inside the door with which the device is associated.

A biasing member 30 is formed integrally with and extends away from the strike portion 14 at a predetermined angular relation therewith. The angle may be virtually any angle of less than 90°. The biasing or retaining member is formed from a generally plate-like rectangular member into a generally V-shaped configuration. The retaining member 30 extends away from the strike plate 14 from an opposite side of the receptacle 24 and in the same direction. As will be seen, the retaining member 30 acts like a spring and biases the vertex 32 of the V shape into contact with a door to clamp the device to the door as seen in FIG. 3.

Figure 2:
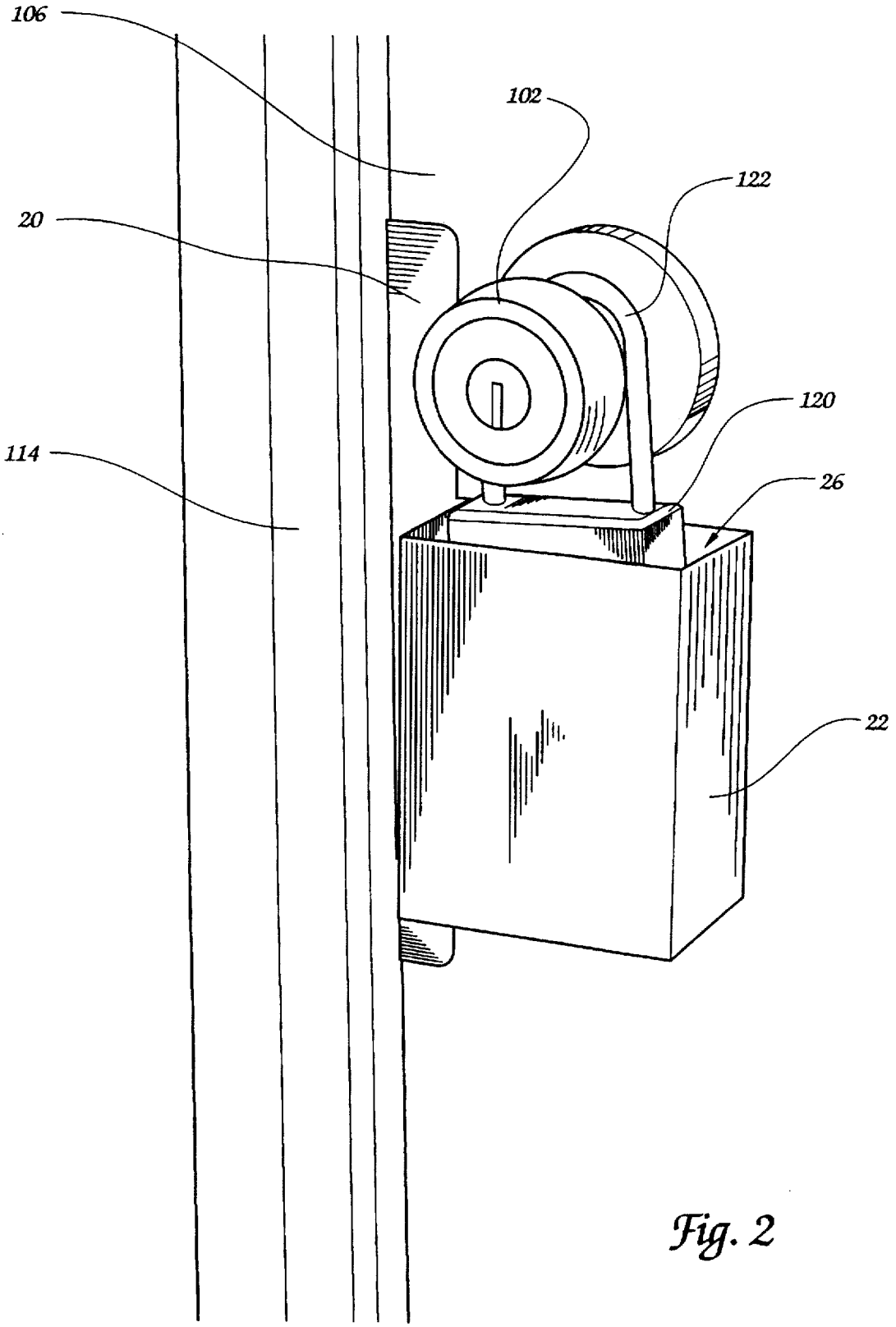
FIG. 2 is a perspective view of the device for blocking access to a lock illustrated in FIG. 1, shown in operation from outside the door with which the device is associated.

In order to shield the key storage container from access, a receptacle 24 is mounted to the face portion 20 of the device 10. The receptacle 24 is formed as a generally rectangular box having four walls 22 and a receiving cavity 26. The bottom of the device may be open or it may be closed. An open box saves material and a closed box denies access to the underside of the storage container, yet would tend to collect moisture. On the other hand, a closed box would preclude the use of a single box on either a left hand or right hand door. Accordingly, an open box is preferred for versatility. In any event, the receptacle 24 is sized to receive therein a lockable key storage container 120 as seen in FIG. 1. As may be expected, once the device is installed, as seen in FIG. 2, the walls 24 of the receptacle 22 act to block access to the key opening 124 on the lockable key storage container 120.

The present invention is very simple to install on a door and is very effective once installed. In order to install the device, reference is made to FIG. 1. There, a user grasps the device in both hands and positions the key storage container 120 within the receiving opening 26 of the receptacle 24. As can be seen in FIG. 1, the storage container 120 may move from side to side on the door knob 102, being held in place by a shank 22 extending around a portion of the door knob 102. With reference to FIG. 5, the retaining member 30 is grasped and pulled away from the receptacle 24 for a short distance. This will allow the device to be positioned on the door 100. A selected opening 16 in the strike place 14 is positioned over a latching member 110 associated with the door 100 and the device is slipped into place with the strike plate 14 in abutment with the strike surface 104 of the door 100. Once installed, the door 100 is closed, with the installer inside the dwelling, to result in the arrangement by which the strike plate 14 is between the strike surface 104 of the door 100 and the door jamb 114 and is therefore inaccessible to anyone attempting to remove the device 10, all as clearly seen in FIGS. 2 and 3. FIG. 2 illustrates the device from outside a door, whereas FIG. 3 illustrates a device from inside a door. As may be ascertained, the key storage container 120 has become inaccessible by use of the device 10 and device 10 may not be removed from a closed door due to the retaining assembly 30 and the portion of the strike plate 14 which engages the latching member 110 should the device be the object of an attempt at removal.

Figure 6:
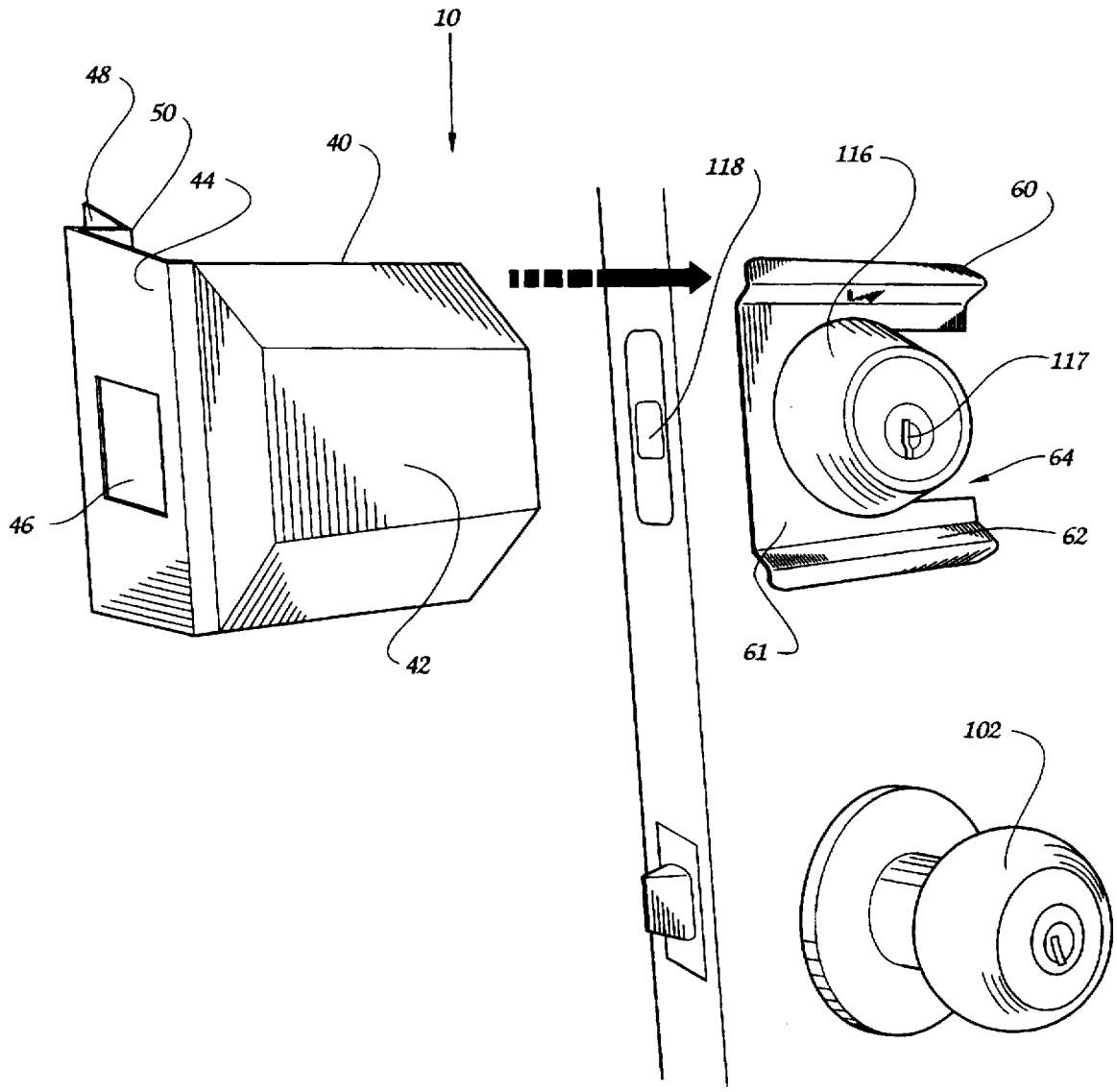
FIG. 6 is a perspective view of a second preferred embodiment of the present invention illustrated during installation.

A second variant of the present invention is illustrated in FIGS. 6–9. The second variant is for use by those who may or may not be using a realty lockbox but is designed for those who want privacy from a keyholder. The second variant is similar to the key storage container cover except that it is configured to cover an existing deadbolt lock interface. As seen in FIG. 6, a device for denying access to the deadbolt lock is illustrated generally at 10 and includes a body 40 having a strike plate 44 formed as a generally rectangular member having an opening 46 formed therein for passage therethrough of a deadbolt locking member 118. A shield is formed as a multi-sided structure 42 to extend perpendicularly away from the strike plate 44. The shield 42 is opened at one end and may or may not be opened at the other end. One end must be opened for installation.

Figure 9:
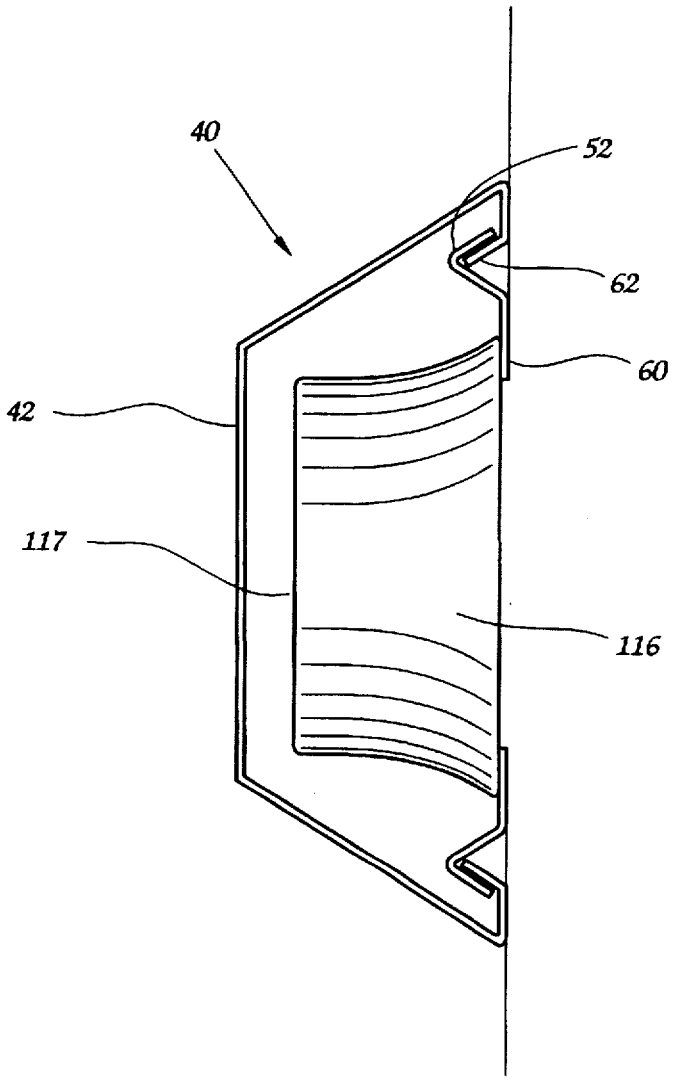
FIG. 9 is a side view of the device for blocking access to a lock illustrated in FIG. 6.

As described with the first variant, the second variant includes a retaining member 48 which extends away from the strike portion 44 at a position opposite that of the shield 42. As before, the biasing member 48 is a rectangular member which is formed into a generally V-shaped member having a vertex 50 for abutment against an inside face of the door. A retaining plate 61 is provided as a generally rectangular member having a U-shaped opening 64 formed in one end thereof. A pair of generally V-shaped flanges 62 project outwardly from either side edge of the retaining plate 61. As seen in FIG. 9, the shield 42 is formed with a plurality of internally projecting ribs 52 which are configured for engagement with the flanges 62, as will be discussed in greater detail hereinafter. The retaining plate 61 is mounted to the door intermediate the cowling 116 of the deadbolt lock and the door.

Figure 7:
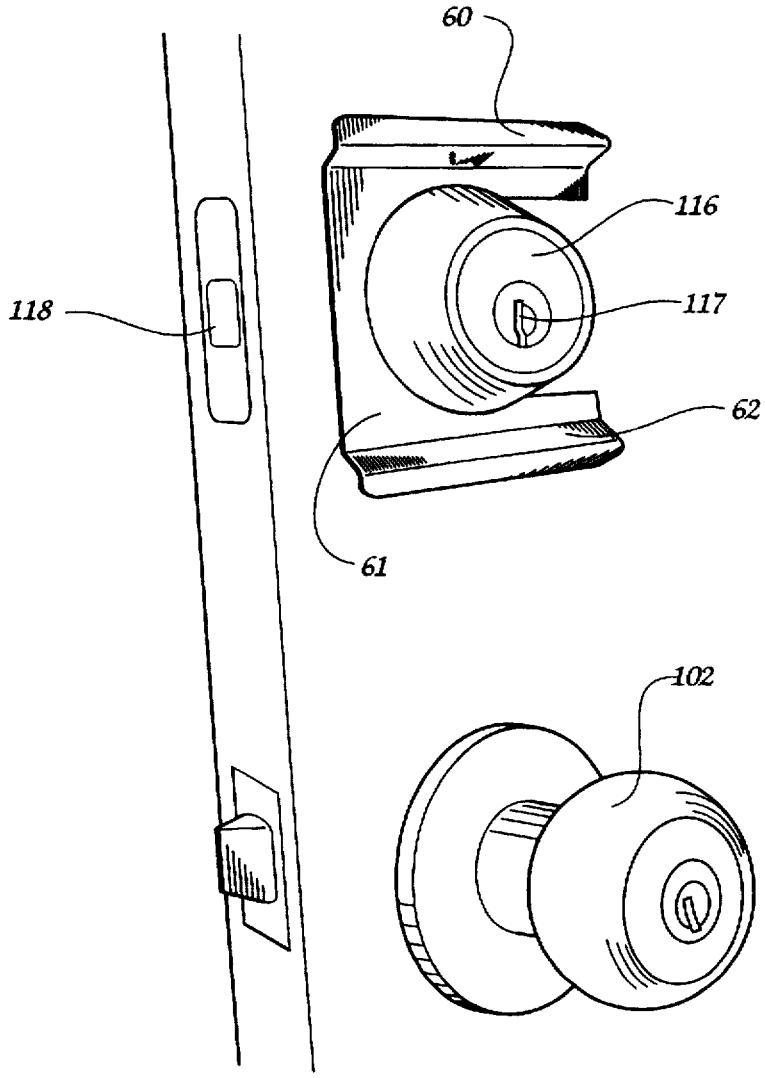
FIG. 7 is a perspective view of a door having the reinforcement plate associated with the second preferred embodiment of the present invention mounted thereto.
Figure 8:
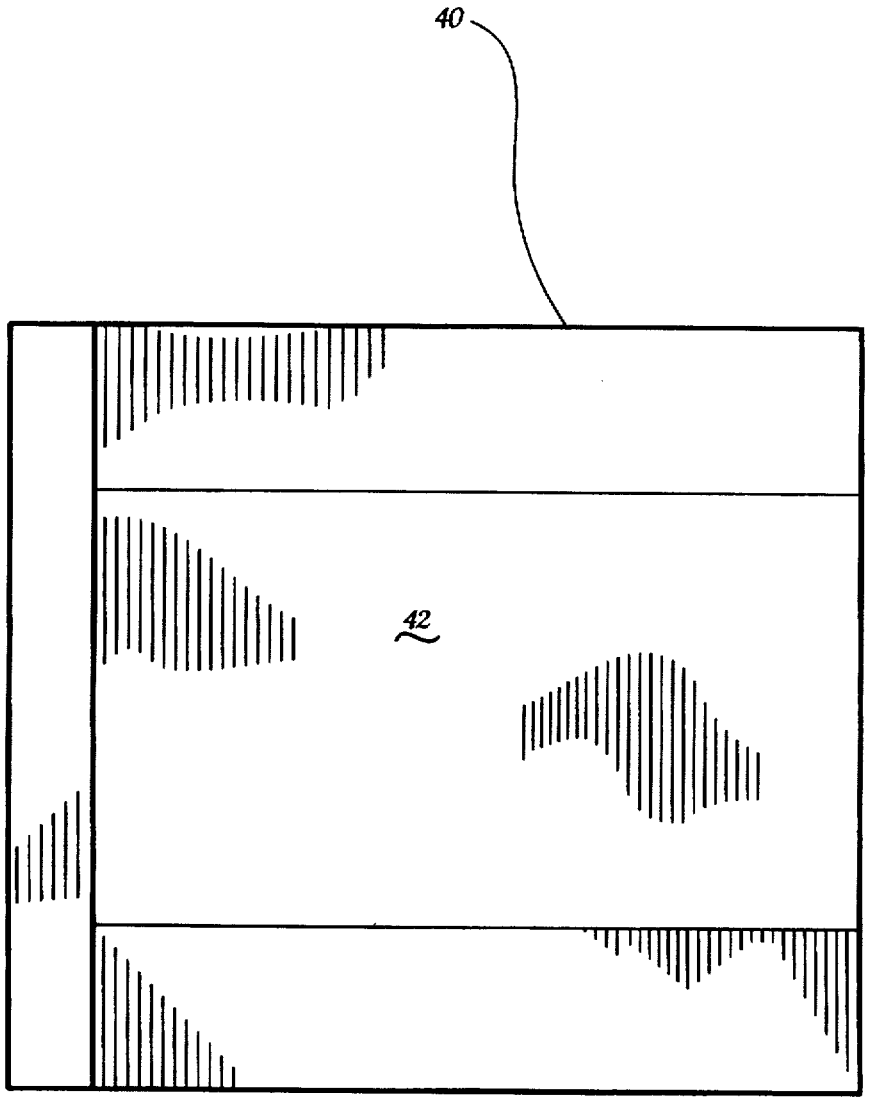
FIG. 8 is a top perspective view of the shield associated with the second preferred embodiment of the present invention.

As seen in FIG. 7, to initially install the device, the retaining plate 61 is mounted to the deadbolt lock intermediate the cowling 116 thereof and the door surface. It is suggested that the U-shaped retaining plate 61 be positioned on the door with the open portion of the U facing away from the door edge to deny access to that portion of the retaining plate 61 which is closed. The reasoning behind this will be explained in greater detail hereinafter.

Once the retaining plate 61 is placed on the door 100, the remainder of the device 10 may be attached to the door. Initially, the biasing member is drawn away from the shield 42 and the device 10 slipped over the retaining plate 60 such that the inner projections 52 extend under the V-shaped flange 62 in a manner seen in FIG. 9. It should be noted that, as discussed above, the opening of the U-shaped portion of the retaining plate 61 should be positioned adjacent the opening in the cover 42. This prevents anyone from trying to pull the retaining plate 61 out from the open side of the shield 42.

Once the device is mounted, the homeowner may close the door, thereby denying access to the deadbolt lock, as well as preventing removal of the covering device. Accordingly, privacy is assured.

By the above, the present invention provides two versions of a device which denies access to the keyhole or operational interface of a door and, once the door is closed, the devices may not be removed therefrom.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A device for preventing access to a key storage container attached to a door, said device comprising:

(a) a body portion formed as a receptacle that is dimensioned to receive and contain therein said key storage container and block access to said key storage container;

(b) attaching means formed with a strike portion arranged to extend across a strike face of said door and including mounting means for mounting said strike portion to the door at the strike face of the door whereby said attaching means will be located between the strike face of the door and a door jamb so as to be inaccessible when said door is closed; and (c) connecting means fixing said body portion to said attaching means to position said receptacle so that said receptacle will receive and contain said key storage container when said mounting means mounts said strike portion to the strike face of said door.

2. A device for preventing access to a key storage container according to claim 1 wherein said strike portion includes an opening formed therein at a position in said strike portion for passage therethrough of a latching member associated with said door on which said device is mounted.

3. A device for preventing access to a key storage container according to claim 2 wherein said strike portion includes at least two openings through which a latching member associated with a door may pass, said at least two openings being symmetrically disposed for using said device on either side of a door.

4. A device for preventing access to a key storage container according to claim 1 wherein said device further comprises a retaining portion extending from said strike portion at a predetermined angular relationship therewith to extend across a second face of a door when said device is mounted to a door.

5. A device for preventing access to a key storage container according to claim 4 wherein said retaining portion is formed as a generally V-shaped flange for biasing a vertex of said V-shaped flange against an inside face of a door to assist in holding said device on a door.

* * * * *